US005950040A

United States Patent [19]

Mestha et al.

[11] Patent Number: 5,950,040

[45] Date of Patent: Sep. 7, 1999

[54] FEEDBACK CONTROL SYSTEM FOR CONTROLLING DEVELOPABILITY OF A XEROGRAPHIC IMAGING DEVICE

[75] Inventors: Lingappa K. Mestha, Fairport; Meera Sampath, Penfield; Yao Rong Wang, Webster, all of N.Y.

[73] Assignee: Xerox Corporation, Stamford, Conn.

[21] Appl. No.: 09/083,140

[22] Filed: May 22, 1998

[51] Int. Cl.[6] ..... G03G 15/00

[52] U.S. Cl. ..... 399/46; 399/38

[58] Field of Search ..... 399/38, 46, 48, 399/49, 53

[56] References Cited

U.S. PATENT DOCUMENTS

| | | | |
|---|---|---|---|
| 4,724,461 | 2/1988 | Rushing | 399/48 |
| 5,003,327 | 3/1991 | Theodoulou et al. | 399/53 X |
| 5,708,916 | 1/1998 | Mestha | 399/49 |
| 5,717,978 | 2/1998 | Mestha | 399/46 |
| 5,749,019 | 5/1998 | Mestha | 399/46 |
| 5,749,021 | 5/1998 | Mestha et al. | 399/49 |
| 5,754,918 | 5/1998 | Mestha et al. | 399/48 |

*Primary Examiner*—Sandra Brase
*Attorney, Agent, or Firm*—Oliff & Berridge, PLC

[57] ABSTRACT

A feedback control system controls developability of a xerographic imaging device that uses optical sensors for measuring development values based upon a target value. The feedback control system includes a controller device and a feedforward device. The controller device includes an input summing node, a gain device, an integrator and a nominal summing node which are serially connected in communication with each other. The input summing node, the gain device and the integrator are operative in combination with each other to receive and process the measured value and the target value to provide an new corrected actuator value to the integrator summing node. The feedforward device is connected to the nominal summing node and receives and responds to the target value to output a nominal actuator value to the nominal summing node. The nominal summing node combines the new corrected actuator value and the nominal actuator value to provide an actuator value to the xerographic imaging device for controlling the developability of the xerographic imaging device. A method for controlling developability of a xerographic imaging device is also described.

23 Claims, 7 Drawing Sheets

FEEDBACK CONTROL SYSTEM FOR CONTROLLING DEVELOPABILITY OF A XEROGRAPHIC IMAGING DEVICE

BACKGROUND OF THE INVENTION

1. Field of Invention

The invention is directed to a feedback control system for a xerographic imaging device. More particularly, the invention relates to a feedback control system for controlling developability of the xerographic imaging device.

2. Description of Related Art

The basic xerographic process used in an xerographic imaging device generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In xerographic imaging devices using a drum-type or an endless belt-type photoconductive member, the photosensitive surface thereof can contain more than one image at one time as it moves through various processing stations. The portions of the photosensitive surface containing the projected images, so-called "image areas" are usually separated by a segment of the photosensitive surface called the "inter-document space". After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface and a fully discharged portion of the photosensitive surface between the image areas.

The approach utilized for multicolor xerographic printing is substantially identical to the process described above. However, rather than forming a single latent image on the photosensitive surface in order to reproduce an original document, as in the case of black and white printing, multiple latent images corresponding to color separations are sequentially recorded on the photosensitive surface. Each single color electrostatic latent image is developed with toner of a color complementary thereto and the process is repeated for differently colored images with respective toner of complementary color. Thereafter, each single color toner image can be transferred to the copy sheet in superimposed registration with the prior toner image, creating a multi-layered toner image on the copy sheet. Finally, this multi-layered toner image is permanently affixed to the copy sheet in a conventional manner to form a finished color copy.

As described, the surface of the photoconductive member must be charged by a suitable device prior to exposing the photoconductive member to a light image. This operation is typically performed by a corona charging device. One type of a corona charging device comprises a current carrying electrode enclosed by a shield on three sides and a wire grid or control screen positioned thereover and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and uniformity of the charge on the photoconductive member is very important because consistently high quality reproductions are best produced when a uniform charge having a predetermined magnitude is obtained on the photoconductive member. If the photoconductive member is not charged to a sufficient level, the electrostatic latent image obtained upon exposure will be relatively weak and the resulting deposition of development material will be correspondingly decreased. As a result, the copy produced by an undercharged photoconductor will be faded. If, however, the photoconductive member is overcharged, too much developer material will be deposited on the photoconductive member. The copy produced by an overcharged photoconductor will have a gray or dark background instead of the white background of the copy paper. In addition, areas intended to be gray will be black and tone reproduction will be poor. Moreover, if the photoconductive member is excessively overcharged, the photoconductive member can become permanently damaged.

A useful tool for measuring voltage levels on the photosensitive surface is an electrostatic voltmeter (ESV) or electrometer. The electrometer is generally rigidly secured to the reproduction machine adjacent the moving photosensitive surface and measures the voltage level of the photosensitive surface as it traverses an ESV probe. The surface voltage is a measure of the density of the charge on the photoreceptor, i.e. the photoconductive member, which is related to the quality of the print output. In order to achieve high quality printing, the surface potential on the photoreceptor at the developing zone should be within a precise range.

In a typical xerographic charging system, the amount of voltage obtained at the point of electrostatic voltage measurement of the photoconductive member, namely, at the ESV, is less than the amount of voltage applied at the wire grid of the point of charge application. In addition, the amount of voltage applied to the wire grid of the corona generator required to obtain a desired constant voltage on the photoconductive member must be increased or decreased according to various factors which affect the photoconductive member. Such factors include the rest time of the photoconductive member between printing jobs, the voltage applied to the corona generator for the previous printing job, the copy length of the previous printing job, machine to machine variance, the age of the photoconductive member and changes in the environment.

One way of monitoring and controlling the surface potential in the development zone is to locate a voltmeter directly in the developing zone and then to alter the charging conditions until the desired surface potential is achieved in the development zone. However, the accuracy of voltmeter measurements can be affected by the developing materials (such as toner particles) such that the accuracy of the measurement of the surface potential is decreased. In addition, in color printing there can be a plurality of developing areas within the developing zone corresponding to each color to be applied to a corresponding latent image. Because it is desirable to know the surface potential on the photoreceptor at each of the color developing areas in the developing zone, it would be necessary to locate a voltmeter at each color area within the developing zone. Cost and space limitations make such an arrangement undesirable.

In a typical charge control system, the point of charge application and the point of charge measurement is different. The zone between these two devices loses the immediate benefit of charge control decisions based on measured voltage error since this zone is downstream from the charging device. This zone may be as great as a belt revolution or more due to charge averaging schemes. This problem is especially evident in aged photoreceptors because their cycle-to-cycle charging characteristics are more difficult to predict. Charge control delays can result in improper charging, poor copy quality and often leads to early photoreceptor replacement. Thus, there is a need to anticipate the behavior of a subsequent copy cycle and to compensate for predicted behavior beforehand.

Various systems have been designed and implemented for controlling processes within a printing machine. For example, U.S. Pat. No. 5,243,383 discloses a charge control system that measures first and second surface voltage potentials to determine a dark decay rate model representative of voltage decay with respect to time. The dark decay rate model is used to determine the voltage at any point on the imaging surface corresponding to a given charge voltage. This information provides a predictive model to determine the charge voltage required to produce a target surface voltage potential at a selected point on the imaging surface.

U.S. Pat. No. 5,243,383 discloses a charge control system that uses three parameters to determine a substrate charging voltage, a development station bias voltage and a laser power for discharging the substrate. The parameters are various difference and ratio voltages.

Achieving consistent print color quality in the xerographic imaging device is a difficult control problem. To ensure satisfactory print quality, the developed mass per unit area also known as DMA must be controlled. Sensors used for monitoring developability are typically optical sensors which are used to measure toner development values on the photoreceptor that represent the DMA. This developability control problem is difficult primarily because of temporal variations in subsystem parameters as well as the presence of external disturbances. Specifically, the developability control problem is difficult because the development system is nonlinear; physical considerations limit obtainable actuator values; multiple disturbance sources such as variations in toner concentration, changes in triboelectricity, loss of developability, variations in toner cohesively and varying area coverages in the document region occur; sensor output of the optical sensor device is noise prone; and developability control must be sufficiently flexible to accommodate DMA targets that change over time. The time-varying targets may arise because of typical drift that occurs in a xerographic imaging device or as a result of a customer requirement for maintaining print quality using different paper types or media.

It would be advantageous if a feedback control system can address the problems stated above to obtain better developability control of the xerographic imaging device. It would also be advantageous if the feedback control system could be a generic control architecture for use with many makes and models of xerographic imaging devices. The invention provides these advantages.

SUMMARY OF THE INVENTION

A feedback control system of the invention controls developability of a xerographic imaging device having at least one optical sensor for measuring at least one development value based upon a target value. The feedback control system includes a controller device and a feedforward device. The controller device includes an input summing node, a gain device, an integrator and a nominal summing node which are serially connected in communication with each other. The input summing node, the gain device and the integrator are operative in combination with each other to receive and process the measured development value and the target value to provide an new corrected actuator value to the nominal summing node. The feedforward device is connected to the nominal summing node an operative to receive and respond to the target value to output a nominal actuator value to the nominal summing node. The nominal summing node combines the new corrected actuator value and the nominal actuator value to provide an actuator value to the xerographic imaging device for controlling the developability of the xerographic printing device.

A method for controlling developability of the xerographic imaging device includes the steps of establishing a difference between the measured value and the target value; multiplying the difference by a gain factor to yield a weighted error; integrating the weighted error with at least one previous weighted error to produce a corrected actuator value; summing the corrected actuator value and the nominal actuator value to yield an actuator value; and, inputting the actuator value to the xerographic imaging device for controlling developability.

BRIEF DESCRIPTION OF THE DRAWINGS

Other features of the invention will become apparent as the following description proceeds and upon reference to the drawings, in which.

DETAILED DESCRIPTION OF PREFERRED EMBODIMENTS

Figure 1:
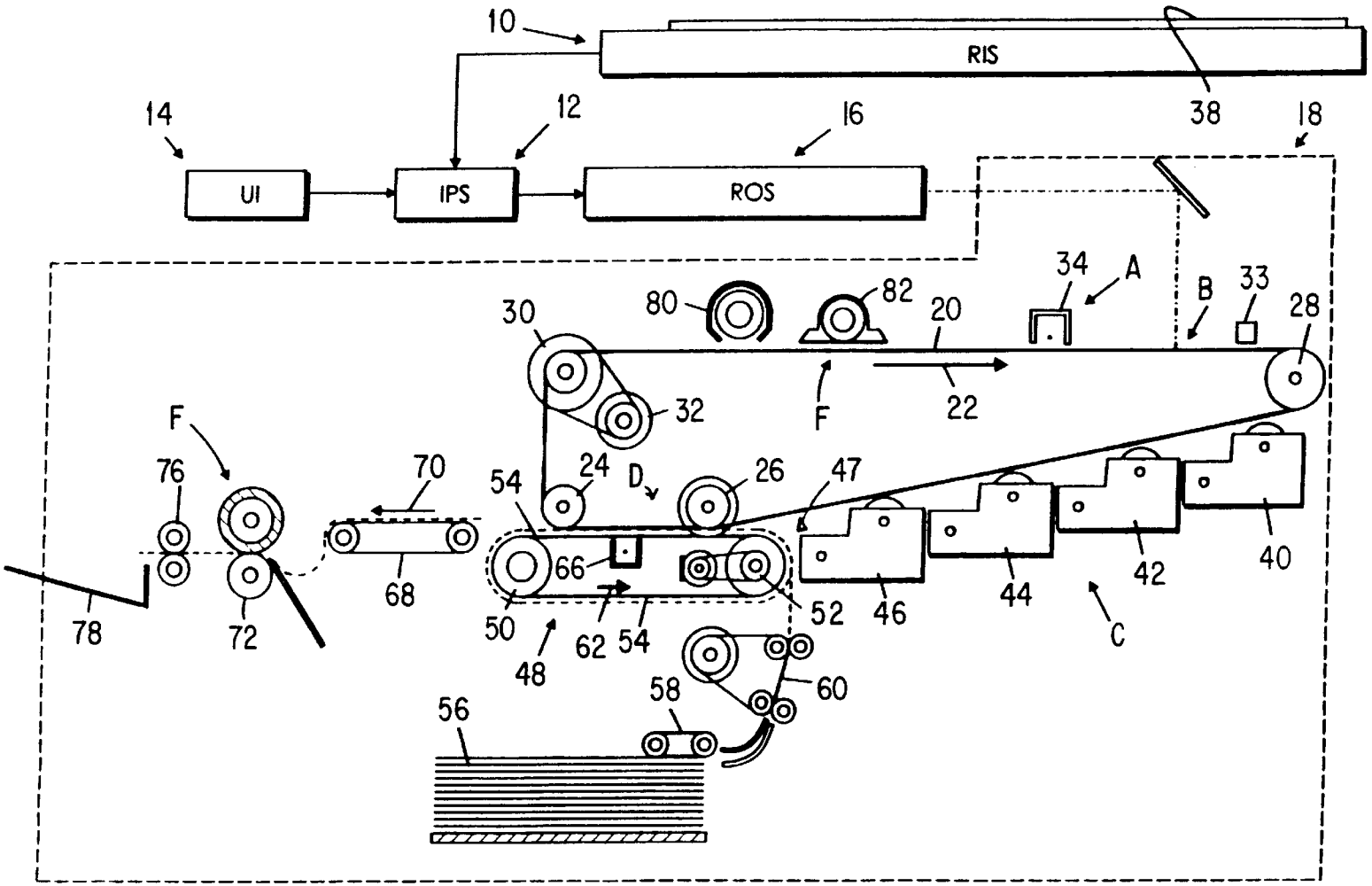
FIG. 1 PRIOR ART
FIG. 1 is a schematic diagram of a conventional multicolor xerographic imaging device.

For a general understanding of the features of the invention, reference is made to the drawings wherein like references have been used throughout to designate identical elements. A schematic elevational view showing a conventional xerographic imaging device 8 capable of performing a xerographic printing process is shown in FIG. 1. It would become evident from the following discussion that the invention is equally well-suited for use in a wide variety of imaging or printing systems including ionographic printing machines and discharge area development systems, as well as other more general non-printing systems providing multiple or variable outputs such that the invention is not necessarily limited in its application to the particular system shown herein.

With reference to FIG. 1, before describing the particular features of the invention in detail, the conventional xerographic imaging device 8 will be described. The xerographic imaging device may be a multicolor copier, as for example, the recently introduced Xerox Corporation "5775" copier. To initiate the copying or xerographic process, a multicolor original document 38 is positioned on a raster input scanner RIS 10. The RIS 10 contains document illumination lamps, optics, a mechanical scanning drive, and a charge coupled device (CCD array) for capturing the entire image from the original document 38. The RIS 10 converts the image to a series of raster scan lines and measures a set of primary color densities, i.e. red, green and blue densities, at each point of the original document. This information is transmitted as an electrical signal to an image processing system IPS 12 which converts the set of red, green and blue density signals to a set of colorimetric coordinates. The IPS 12 contains control electronics for preparing and managing the image data flow to a raster output scanner ROS 16.

A user interface UI 14 is provided for communicating with the IPS 12. The UI 14 enables an operator to control the various operator adjustable functions whereby the operator actuates the appropriate input keys of the UI 14 to adjust the parameters of the copy. The UI 14 may be a touch screen, or any other suitable device for providing an operator interface with the xerographic system. The output signal from the UI 14 is transmitted to the IPS 12 which then transmits signals corresponding to the desired image to the ROS 16.

The ROS 16 includes a laser with rotating polygon mirror blocks. The ROS 16 eliminates, via a multi-facet polygonal mirror 37, a charged portion of a photoreceptor belt 20 of a printer or marking engine 18. Preferably, the mirror 37 is used to illuminate the photoreceptor belt 20 at a rate of about 400 pixels per inch. The ROS 16 exposes the photoreceptor belt 20 to record a set of three subtractive primary latent images thereon corresponding to the signals transmitted from the IPS 12. One latent image is to be developed with cyan developer material, another latent image is to be developed with magenta developer material and the third latent image is to be developed with yellow developer material. These developed images are subsequently transferred to a copy sheet in superimposed registration with one another to form a multicolored image on the copy sheet or print 56*a* or 56*a*' which is then fused thereto to form a color copy. This process is discussed in greater detail below.

With continued reference to FIG. 1, the printer or marking engine 18 is an electrophotographic printing machine comprising the photoreceptor belt 20 which is entrained about transfer rollers 24 and 26, a tensioning roller 28 and a drive roller 30. The drive roller 30 is rotated by a motor or other suitable mechanism coupled to the drive roller 30 by suitable means such as a belt drive 32 as the drive roller 30 rotates, it advances the photoreceptor belt 20 in a direction of arrow 22 to sequentially advance successive portions of the photoreceptor belt 20 through various processing stations disposed about the path of movement thereof.

The photoreceptor belt 20 is preferably made from a polychromatic photoconductive material comprising an anti-curl layer, a supporting substrate layer and an electrophotographic imaging single layer or multi-layers. The imaging layer may contained homogeneous, heterogeneous, inorganic or organic compositions. Preferably, finely divided particles of a photoconductive inorganic compound are dispersed in an electrically insulating organic resin binder. Typical photoconductive particles include metal-free phthalocyanine, such as copper phthalocyanine, quinacridones 2,4-diaminotriazines and polynuclear aromatic quinines. Typical organic resinous binders include polycarbonates, acrylate polymers, vinyl polymers, cellulose polymers, polyesters, polysiloxanes, polyamides, polyurethanes, epoxies and the like.

Initially, a portion of the photoreceptor belt 20 passes through an electrostatic charging station A. At the electrostatic charging station A, a corona generating device 34 or other charging device generates a charge of voltage to charge the photoreceptor belt 20 to a relatively high, substantially uniform voltage potential. The corona generator device 34 comprises a corona generating electrode, a shield partially enclosing the electrode, and a grid that dispose between the photoreceptor belt 20 and an unenclosed portion of the electrode. The electrode charges the photoconductive surface of the photoreceptor belt 20 via corona discharge with an electrostatic charge. The voltage potential applied to the photoconductive surface of the photoreceptor belt 20 is varied by controlling the voltage potential of the wire grid.

Next, the charged photoconductive surface is rotated to an exposure station B. The exposure station B receives a modulated light beam corresponding to information derived by the RIS 10 having the multicolored original document 38 positioned thereon. The modulated light beam impinges on the surface of the photoreceptor belt 20, selectively illuminating the charged surface of the photoreceptor belt 20 to form an electrostatic latent image thereon. The photoconductive belt 20 is exposed three times to record three latent images representing each color.

After the electrostatic latent images have been recorded on the photoreceptor belt 20, the photoreceptor belt 20 is advanced towards a toner development station C. However, before reaching the toner development station C, the photoreceptor belt 20 passes subjacent to a voltage monitor, preferably an electrostatic voltmeter 33, for measurement of the voltage potential at the surface of the photoreceptor belt 20. The electrostatic voltmeter 33 can be any suitable type known in the art wherein the charge on the photoconductive surface of the photoreceptor belt 20 is sensed such as disclosed in U.S. Pat. Nos. 3,870,968; 4,205,257; or 4,853,639, the contents of which are incorporated by reference herein.

A typical electrostatic voltmeter is controlled by a switching arrangement which provides a measuring condition in which charge is induced on a probe electrode corresponding to the sensed voltage level of the photoreceptor belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the invention. The voltage potential measurement of the photoreceptor belt 20 is utilized to determine specific parameters for maintaining a predetermined potential on the photoreceptor surface, as will be understood with reference to the specific subject matter of the invention, explained in detail below.

The toner development station C includes four individual developer units indicated by reference numerals 40, 42, 44 and 46. The developer units 40, 42, 44 and 46 are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of development material into contact with the photoconductive surface.

The developer units 40, 42 and 44, respectively, apply toner particles of a specific color corresponding to the complement of the specific color separated electrostatic latent image recorded on the photoconductive surface. Each of the toner particles is adapted to absorb light within a preselected spectral region of the electromagnetic wave spectrum. For example, an electrostatic latent image formed by discharging the portions of charge on the photoreceptor belt 20 corresponding to the green regions of the original document will record the red and blue portions as areas of relatively high charge density on the photoreceptor belt 20, while the green areas will be reduced to a voltage level ineffective for development. The charged areas are then made visible by having the developer unit 40 apply green absorbing (magenta) toner particles onto the electrostatic latent image recorded on the photoreceptor belt 20. Similarly, a blue separation is developed by developer unit 42 with blue absorbing (yellow) toner particles while the red separation is developed by the developer unit 44 with red absorbing (cyan) toner particles. The developer unit 46 contains black toner particles and may be used to develop the electrostatic image formed from a black and white original document.

In FIG. 1, the developer unit 40 is shown in the operative position with the developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoreceptor belt 20, while in the non-operative position, the magnetic brush is spaced therefrom. Thus, each electrostatic latent image or panel is developed with toner particles of the appropriate color without commingling.

After development, the toner image is moved to an electrostatic transfer station D. The electrostatic transfer station D includes a transfer zone 64 defining the position at which the toner image is transferred to the copy sheet or print 56*a*', which may be a sheet of plain paper or any other suitable support substrate. A sheet transport apparatus 48 moves the copy sheet 56*a*' into contact with the photoreceptor belt 20. The sheet transport 48 has a belt 54 entrained about a pair of substantially cylindrical rollers 50 and 52. A friction retard feeder 58 advances the uppermost sheet from a stack 56 of copy sheets onto a pre-transfer transport 60 for advancing the copy sheet to the sheet transport apparatus 48 in synchronism with the movement thereof so that a leading edge of the copy sheet arrives at a preselected position, i.e. a loading zone. The copy sheet is received by the sheet transport apparatus 48 for movement therewith in a recirculating path. As belt 54 of the sheet transport apparatus 48 moves in a direction of arrow 62, the sheet is moved into contact with the photoreceptor belt 20, in synchronism with the toner image developed thereon.

In the transfer zone 64, a corona generating device 66 sprays ions onto a backside of the copy sheet so as to charge the copy sheet to the proper magnitude and polarity for attracting the toner image from the photoreceptor belt 20 thereto. The copy sheet remains secured to a sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another to the sheet for forming the multi-color copy of the colored original document. One skilled in the art will appreciate that the sheet may move in a recirculating path for four cycles when undercolor black removal is used.

After the last transfer operation, the sheet transport apparatus 48 directs the sheet to a vacuum conveyor 68. The vacuum conveyor 68 transports the sheet in a direction of arrow 70 to a fusing station E where the transferred toner image is permanently fused to the sheet. The fusing station E includes a heated fuser roller 74 and a pressure roller 72. The sheet passes through a nip defined by the fuser roller 74 and the pressure roller 72. The toner image contacts the fuser roller 74 so as to be fixed to the sheet. Thereafter, the sheet is advanced by a pair of rolls 76 to a catch tray 78 for subsequent removal therefrom by the machine operator.

The last processing station in the direction of movement of the photoreceptor belt 20, as indicated by the arrow 22, is a cleaning station F. A lamp 80 illuminates the surface of the photoreceptor belt 20 to remove any residual charge remaining thereon. Thereafter, a rotatably mounted fibrous brush 82 is positioned in the cleaning station F and maintained in contact with the photoreceptor belt 20 to remove any residual toner particles remaining from the transfer operation prior to the start of the next successive imaging cycle.

Figure 2:
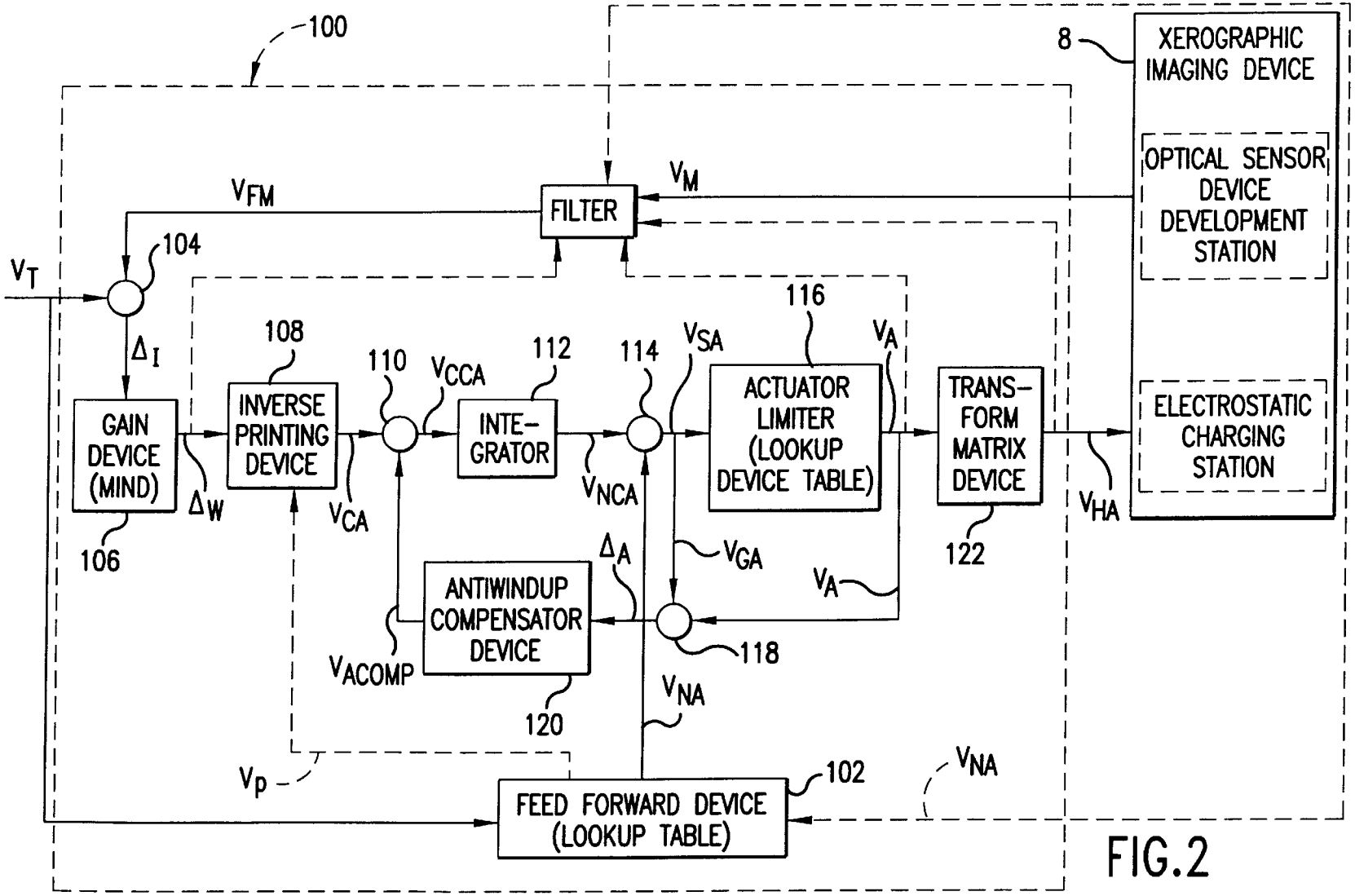
FIG. 2 is a block diagram of a first embodiment of a feedback control system of the invention operable connected to the xerographic imaging device of FIG. 1.

A first embodiment of a feedback control system 100 of the invention is introduced in FIG. 2. The feedback control system 100 of the invention controls developability of the xerographic imaging device 8 that has at least one optical sensor device 47 located at the toner development station C. The optical sensor device 47 measures at least one measured value $V_M$ which is desired to be converged to the at least one target value $V_T$. The at least one target value $V_T$ is provided by either a target lookup table, a customer input or other means. One of ordinary skill in the art would appreciate that the measured value $V_M$ and the target value $V_T$ can each be either a single value or multiple values as is known in the industry. Furthermore, a skilled artisan would appreciate that measured value $V_M$ and the target value $V_T$ can be selected from an identical type of development values with each type including toner development values, area coverage, toner density, relative reflectance and contone values. The feedback control system 100 of the invention includes a feedforward device 102, and input summing node 104, a gain device 106, an inverse printing device 108 in a form of an inverse sensitivity matrix device, a compensator summing node 110, an integrator 112, a nominal summing node 114, an actuator limiter device 116, a limiter summing node 118, and an antiwindup compensator device 120 and a transform matrix device 122.

The feedforward device 102 which includes a lookup table receives and responds to the target value $V_T$ and outputs a nominal actuator value $V_{NA}$ and parameters $V_P$ for the inverse printing device 108. Additional details regarding the feedforward device 102 can be found in U.S. Pat. No. 5,749,019 which is incorporated herein by reference for all purposes.

The input summing node 104 receives a filtered measured value $V_{FM}$ and the target value $V_T$. The input summing node 104 determines and outputs a difference $\Delta_I$ between the filtered measured value $V_{FM}$ and the target value $V_T$.

The gain device 106 is serially connected in communication with the input summing node 104 and receives the difference $\Delta_I$ and multiplies the difference $\Delta_I$ by a gain factor to yield a weighted error $\Delta_W$. A skilled artisan would appreciate that the gain device 106 can be either a single input single output (SISO) gain device or a multiple input multiple output (MIMO) gain device depending upon whether the target value $V_T$ and the measured value $V_M$ are single values or multiple values. For further details regarding the gain device 106, the gain factor, the integrator 112 and the nominal summing node 114, reference is made to U.S. Pat. No. 5,717,978 which is incorporated herein by reference for all purposes. Although not by way of limitation, the gain device 106 for the first embodiment of the feedback control system 100 of the invention is a MIMO (multiple input multiple output) gain device.

The inverse printing device 108 which is either a numerical model or a mathematical model of the developability control system 100 of the invention is connected in communication with the gain device 106 so that the inverse printing device 108 receives the weighted error $\Delta_W$. Also, the inverse printing device 108 is connected in communication with the feedforward device 102 so that the inverse printing device 108 receives the parameters $V_P$ of the inverse printing device periodically from the feedforward device 102. The inverse printing device 108 adjusts the weighted error $\Delta_W$ by an inverse sensitivity factor to output a corrected actuator value $V_{CA}$. For further details regarding the inverse printing device 108, please refer to U.S. Pat. No. 5,749,019 which is incorporated herein by reference for all purposes.

The compensator summing node 110 is serially connected in communication with the inverse printing device 108 so that the compensator summing node 110 receives the corrected actuator value $V_{CA}$. The compensator summing node 110 also receives a compensated actuator value $V_{ACOMP}$ which is discussed in more detail below. The compensator summing node 110 sums the corrected actuator value $V_{CA}$ and the compensated actuator value $V_{ACOMP}$ to produce a compensated corrected actuator value $V_{CCA}$.

The integrator 112 is serially connected in communication with the compensator summing node 110. The integrator 112 receives and integrates the compensated corrected actuator value $V_{CCA}$ to yield a new corrected actuator value $V_{NCA}$.

The nominal summing node 114 is serially connected in communication with the integrator 112. The nominal summing node receives the new corrected actuator value $V_{NCA}$ from the integrator 112 and also receives the nominal actuator value $V_{NA}$ from the feedforward device 102 to produce a summed actuator value $V_{SA}$.

The actuator limiter device 116 is serially connected in communication with the nominal summing node 114. The actuator limiter device 116 receives the summed actuator value $V_{SA}$ and determines whether the summed actuator value $V_{SA}$ is within or at a predetermined range of actuator values. The predetermined range of actuator values is defined as a minimum actuator value, a maximum actuator value and an intermediate actuator value. The intermediate actuator value is defined as having a value that is between the minimum actuator value and the maximum actuator value. When the actuator limiter device 116 determines that the summed actuator value $V_{SA}$ is either the minimum actuator value, the maximum actuator value or the intermediate actuator value, an actuator value $V_A$ is output from the actuator limiter device 116. When the actuator limiter device 116 determines that the summed actuator value $V_{SA}$ exceeds the maximum actuator value, the maximum actuator value is output as the actuator value $V_A$. Further, when the actuator limiter device 116 determines that the summed actuator value $V_{SA}$ is less than the minimum actuator value, the minimum actuator value is output as the actuator value $V_A$.

The limiter summing node 118 is operative to receive and sum the summed actuator value $V_{SA}$ and the actuator value $V_A$ in order to yield an actuator value difference $\Delta_A$. The antiwindup compensator device 120 is serially connected in communication with the limiter summing node 118. The antiwindup compensator device 120 produces and outputs the compensated actuator value $V_{ACOMP}$ to the compensator summing node 110 which is summed with the corrected actuator value $V_{CA}$ to yield the compensated corrected actuator value $V_{CCA}$.

The transform matrix device 122 is serially connected in communication with the actuator limiter device 116. The transform matrix device 122 is operative to receive and transform the actuator value $V_A$ into a hard actuator value $V_{HA}$ and to output the hard actuator value $V_{HA}$ to the xerographic imaging device 8.

Note the optical sensor device 47 of the xerographic imaging device 8 produces the measured value $V_M$ and transmits the measured value $V_M$ to a filter 124 so that noise in the measured value $V_M$ can be filtered therefrom. As a result, the filter 124 produces the filtered measured value $V_{FM}$. Also, although not by way of limitation, the weighted error $\Delta_W$ as well as the nominal actuator value $V_{NA}$ are also used in filter 124 to produce filtered measured value $V_{FM}$. The filter 124 can also use the actuator value $V_A$ and the hard actuator value $V_{HA}$.

Figure 3:
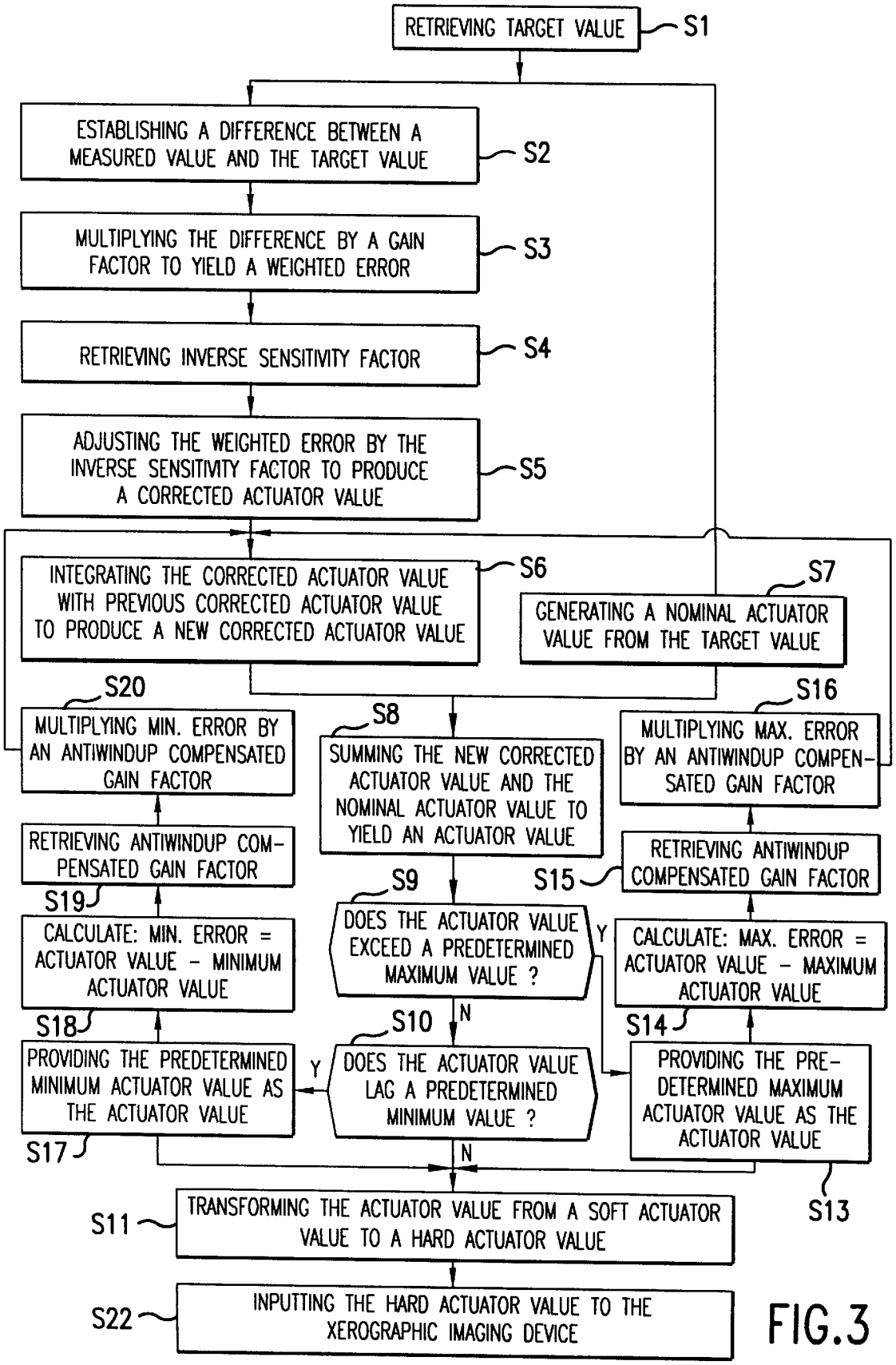
FIG. 3 is a flow chart illustrating steps to practice the feedback control system of the invention in FIG. 2.

A method for practicing the feedback control system 100 of the invention is described in FIG. 3. Step S1 retrieves the target value $V_T$. Step 2 establishes the difference $\Delta_I$ between the measured value $V_M$ and the target value $V_T$. One of ordinary skill in the art would appreciate that the measured value $V_M$ might first be filtered prior to establishing the difference $\Delta_I$. Step S2 multiplies the difference $\Delta_I$ by the gain factor to yield the weighted error $\Delta_W$. Step S4 retrieves the inverse sensitivity factor. Step 5 adjusts the weighted error $\Delta_W$ by the inverse sensitivity factor to produce the corrected actuator value $V_{CA}$. Step S6 integrates the corrected actuator value $V_{CA}$ with at least one previous corrected actuator value $V_{CA}$ which is stored in the integrator 112 to produce the new corrected actuator value $V_{NCA}$. Step S7 generates the nominal actuator value $V_{NA}$ from the target value $V_T$ produced in the feedforward device 102. Step S8 sums the new corrected actuator value $V_{NCA}$ and the nominal actuator value $V_{NA}$ to yield the summed actuator value $V_{SA}$.

Step S9 determines whether the actuator value $V_A$ exceeds a predetermined maximum actuator value while step S10 determines whether the actuator value $V_A$ lags the predetermined minimum actuator value. If the actuator value $V_A$ does not exceed the predetermined maximum actuator value or lags the predetermined minimum actuator value, the process proceeds to step S11. In step S11, which is discussed below, the actuator value $V_A$ is provided.

If, in step S9, it is determined that the actuator value $V_A$ exceeds the predetermined maximum actuator value, the process proceeds to step S13 that provides the predetermined maximum actuator value as the actuator value $V_A$ to step S11. Also, the process proceeds to step S14 wherein a max. error is calculated. The max. error is equal to the actuator value $V_A$ minus the predetermined maximum actuator value. Step S15 retrieves an antiwindup compensated gain factor and step S16 multiplies the max. error by the antiwindup compensated gain factor to produce the compensated actuator value $V_{ACOMP}$ which is provided for summing to Step S6.

If, in step S10, it is determined that the actuator value $V_A$ lags the predetermined minimum actuator value, the process proceeds to S17 which provides the predetermined minimum actuator value as the actuator value $V_A$ to step 11. Also, the process proceeds to step S18 wherein a min. error is calculated. The min. error is equal to the actuator value $V_A$ minus the predetermined minimum actuator value. Step S19 retrieves the antiwindup compensated gain factor and step S20 multiplies the min. error by the antiwindup compensated gain factor to produce the compensated actuator value $V_{ACOMP}$ which is provided for summing to Step S6.

With the actuator value $V_A$ established either through Steps S8, S13 or S17, the actuator value $V_A$ is transformed to a hard actuator value $V_{HA}$ in Step 11. In Step 22, the hard actuator value $V_{HA}$ is input to the xerographic imaging device 8.

Figure 4:
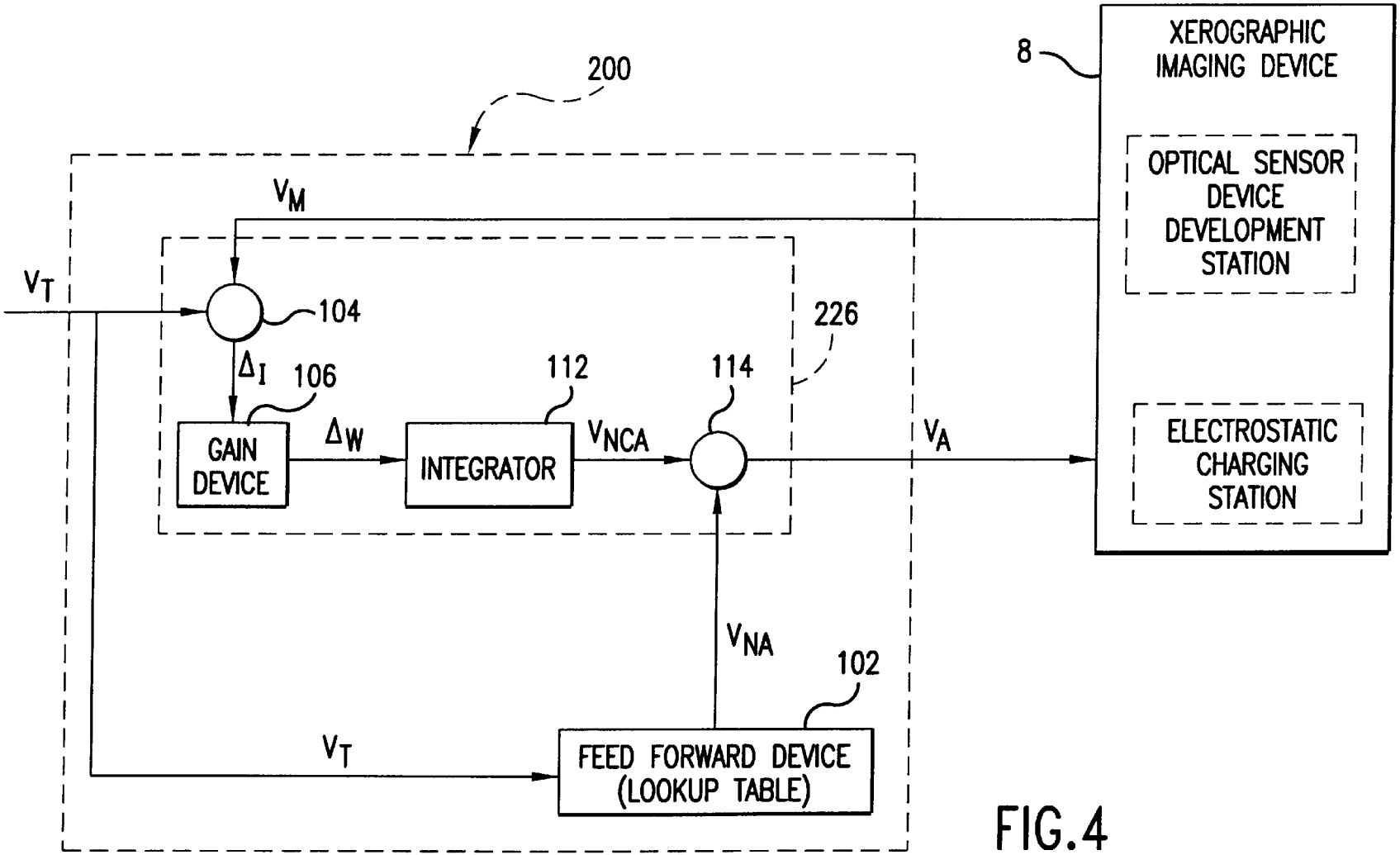
FIG. 4 is a block diagram of a second embodiment of the feedback control system of the invention operably connected with the xerographic imaging device of FIG. 1.

A second embodiment of a feedback control system 200 of the invention is illustrated in FIG. 4. The feedback control system 200 of the invention includes a controller device 226 and the feedforward device 102. The controller device 226 is discussed further in U.S. Pat. No. 5,749,021 which is incorporated herein by reference for all purposes. The controller device 226 includes the input summing node 104, the gain device 106, the integrator 112 and the nominal summing node 114 which are serially connected in communication with each other. The input summing node 104, the gain device 106 and the integrator 112 are operative in combination with each other to receive and process the measured value $V_M$ and the target value $V_T$ to provide the new corrected actuator value $V_{NCA}$ to the nominal summing node 114. In the second embodiment of the feedback control system 200 of the invention, the gain device 106 provides the weighted error $\Delta_W$ directly to the integrator 112.

The feedforward device 102 is connected to the nominal summing node 114. The feedforward device 102 receives and responds to the target value $V_T$ to output the nominal actuator value $V_{NA}$ to the nominal summing node 114. The nominal summing node 114 combines the new corrected actuator value $V_{NCA}$ and the nominal actuator value $V_{NA}$ to provide the actuator value $V_A$ to the xerographic imaging device 8 in order to control developability of the xerographic imaging device 8.

Figure 5:
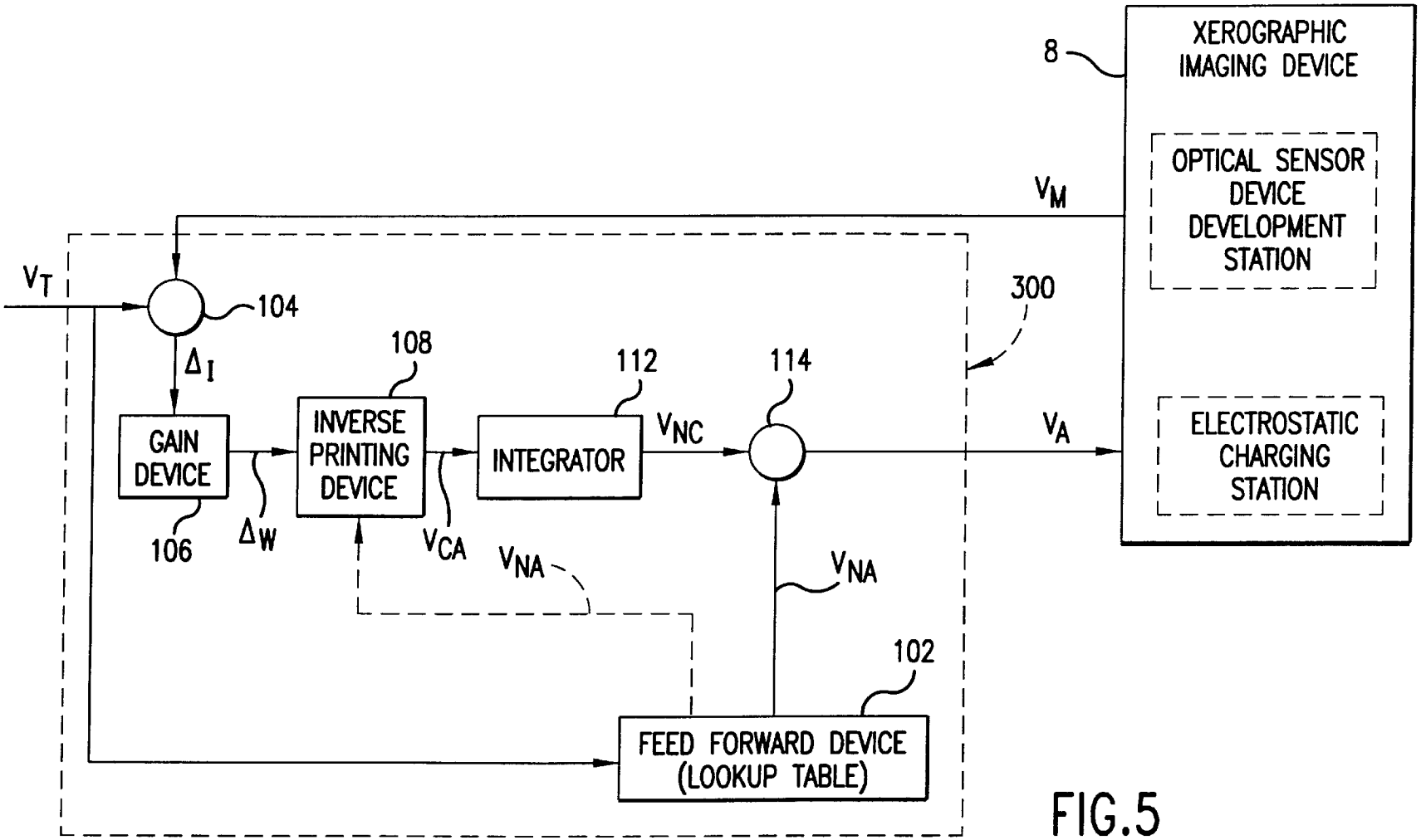
FIG. 5 is a block diagram of a third embodiment of the feedback control system of the invention operably connected with the xerographic imaging device of FIG. 1.

A third embodiment of the feedback control system 300 of the invention is illustrated in FIG. 5. The third embodiment of the feedback control system 300 of the invention is similar to the second embodiment of the feedback control system 200 of the invention described above except that the inverse printing device 108 is introduced between the gain device 106 and the integrator 112. Specifically, the inverse printing device 108 is connected to the gain device 106, the integrator 112 and the feedforward device 102. The inverse printing device 108 receives the weighted error $\Delta_W$ from the gain device 106 and the nominal actuator value $V_{NA}$ from the feedforward device 102 to provide the corrected actuator value $V_{CA}$ to the integrator 112 which provides the new corrected actuator value $V_{NCA}$ to the nominal summing node 114. The nominal summing nodel 14 then provides the actuator value $V_A$ to the xerographic imaging device 8. Although not by way of limitation, the feedforward device 102 provides the inverse printing device 108 with a new nominal actuator value when a customer changes the operating parameters of the xerographic imaging device 8.

Figure 6:
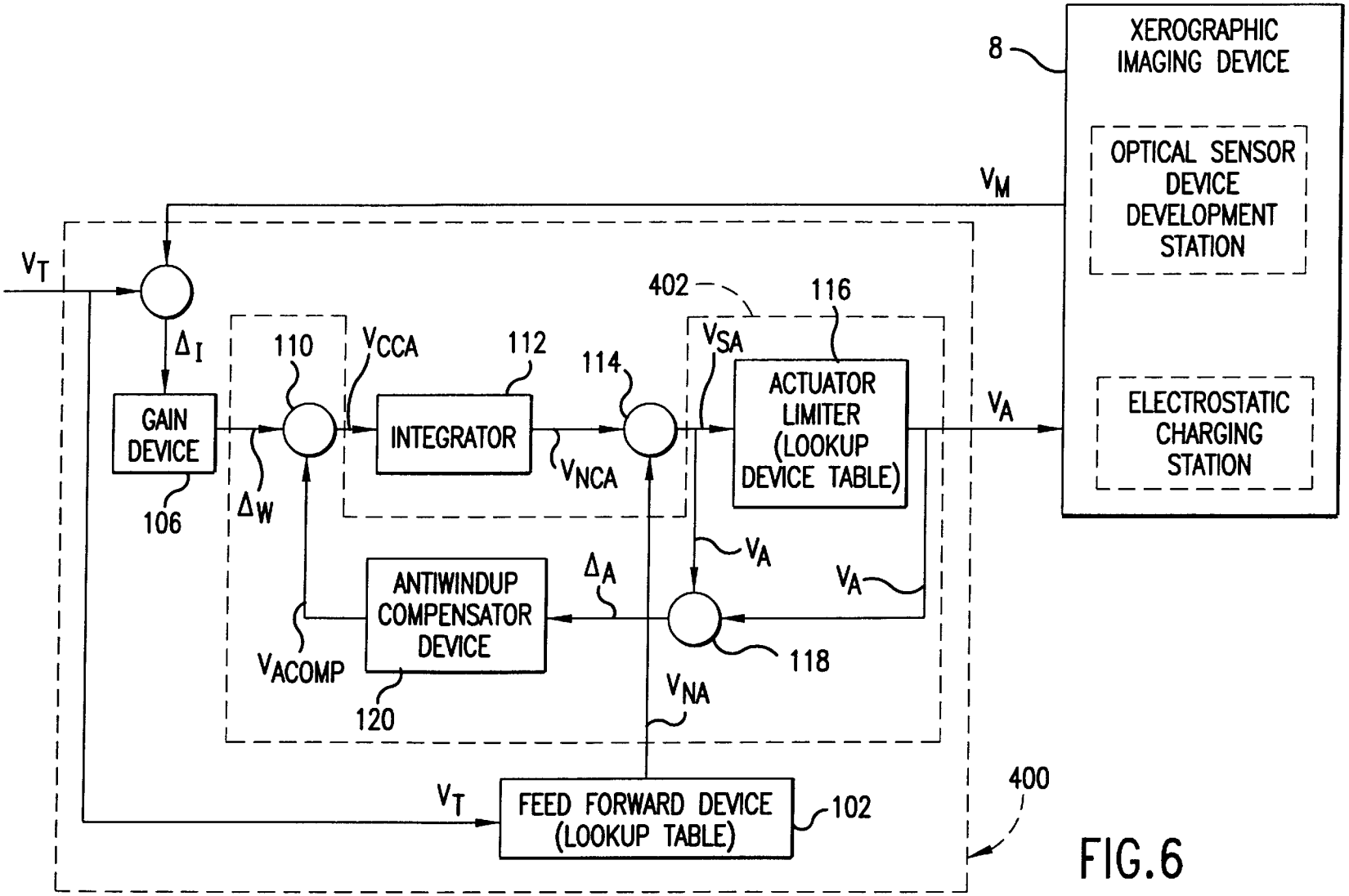
FIG. 6 is a block diagram of a fourth embodiment of the feedback control system of the invention operably connected to the xerographic imaging device of FIG. 1.

A fourth embodiment of the feedback control system 400 of the invention is illustrated in FIG. 6. The feedback control system 400 of the invention is similar to the feedback control system 200 of the invention described above. However, an actuator value range determination and compensation device 402 is included. The actuator range determination and compensation device 402 determines whether the actuator value $V_A$ is within the predetermined range of actuator values which are defined as the minimum actuator value, the maximum actuator value and the intermediate actuator value described above and provides a compensated value to the integrator 112.

The actuator range determination and compensation device 402 includes the actuator limiter device 116, the limiter summing node 118, the antiwindup compensator device 120 and the compensator summing node 110 which are serially connected in communication with each other. The actuator limiter device 116 has an actuator value lookup table that contains the minimum actuator value the maximum actuator value and the intermediate actuator values. The actuator limiter device 116 provides the actuator value $V_A$ to the xerographic imaging device 8.

The limiter summing node 118 receives the summed actuator value $V_{SA}$ from the nominal summing node 114 and also receives the actuator value $V_A$ from the actuator limiter device 116. The limiter summing node 118 determines the actuator value difference AA between the summed actuator value $V_{SA}$ from the nominal summing node 114 and the actuator value $V_A$ from the actuator limiter device 116. The antiwindup compensator device 120 receives the actuator value difference AA from the limiter summing node 118 and provides the compensated actuator value $V_{ACOMP}$ to the compensator summing node 110 that is disposed between and in connection with the integrator 112 and the gain device 106 so that the compensator summing node 110 receives the weighted error $\Delta_W$ from gain device 106. The compensator summing node 112 receives the weighted error $\Delta_W$ from the gain device 106 and the compensated actuator value $V_{ACOMP}$ from the antiwindup compensator device 120 to produce the compensated corrected actuator value $V_{CCA}$.

Figure 7:
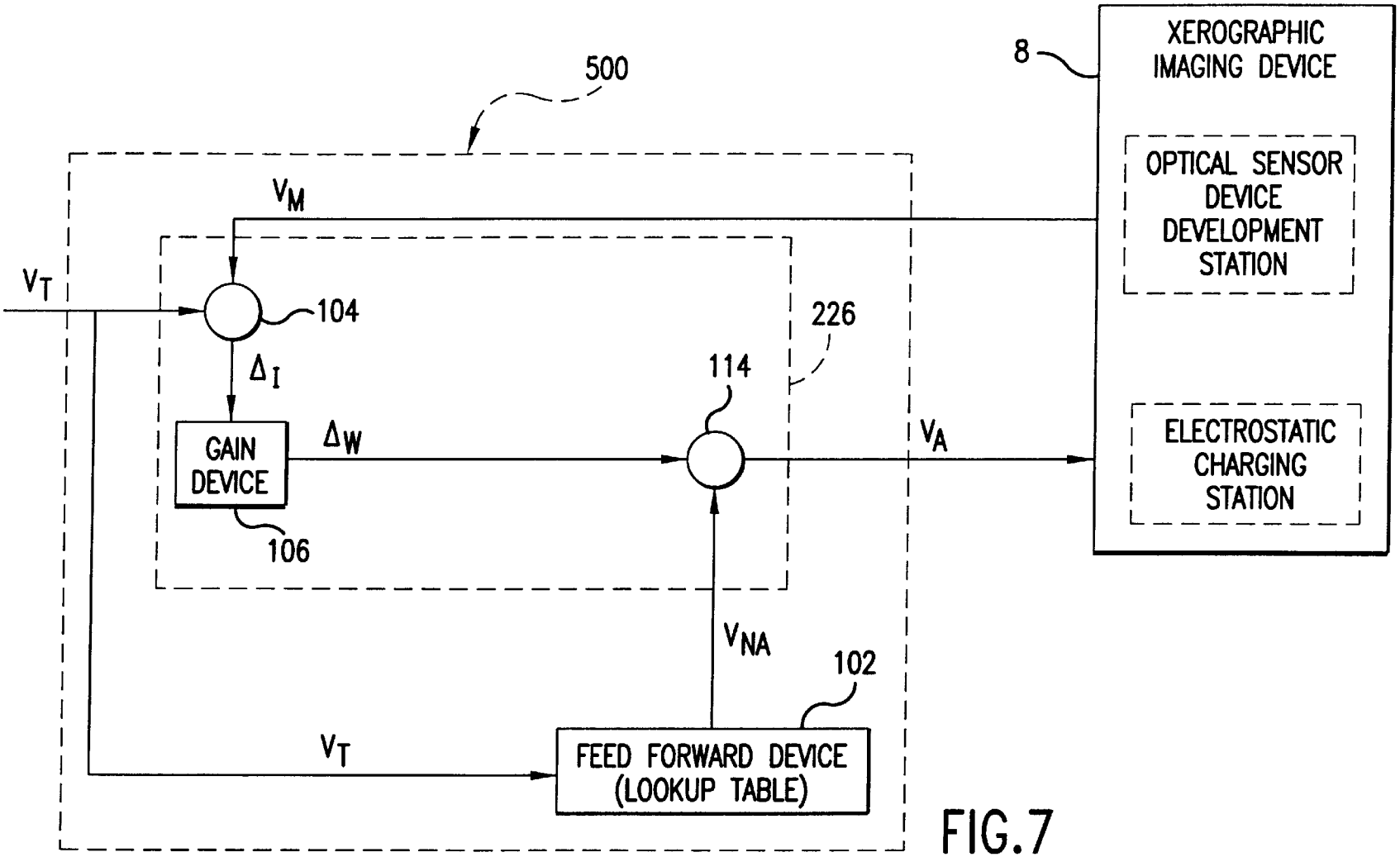
FIG. 7 is a block diagram of a fifth embodiment of the feedback control system of the invention.

A fifth embodiment of a feedback control system 500 of the invention is shown in FIG. 7 and includes a controller device 226. The controller device 226 includes the input summing node 104, the gain device 106, and the nominal summing node 114. These components are serially connected in communication with each other such that the input summing node 104 and the gain device 106 are operative in combination with each other to receive and process the measured value $V_M$ and the target value $V_T$ to provide a weighted error to the nominal summing node 114 which, in turn, provides the actuator value $V_A$ to the xerographic imaging device 8. Otherwise, the fifth embodiment of the invention operates similarly as the third embodiment of the invention.

The feedback control system of the invention provides improved developability control when used with conventional xerographic imaging devices. Also, the feedback control system of the invention is one of a generic architecture so that it can be used with many types of xerographic imaging devices.

The invention has been described with particularity in connection with several embodiments. However, it should be appreciated that changes may be made to the disclosed embodiments of the invention without departing from the spirit and inventive concepts contained herein.

What is claimed is:

1. A feedback control system for controlling an operation of an imaging device having at least one sensor for measuring at least one value from a device in the imaging device given a target value, the feedback control system comprising:

a controller device including an input summing node, a gain device, an integrator and a nominal summing node serially connected in communication with each other, the input summing node, the gain device and the integrator operative in combination with each other to receive and process the measured value and the target value to provide a new corrected actuator value to the nominal summing node;

a feedforward device connected to the nominal summing node and operative to receive and respond to the target value to output a nominal actuator value to the nominal summing node wherein the nominal summing node combines the new corrected actuator value and the nominal actuator value to provide an actuator value to the imaging device for controlling the imaging device; and an inverse printing device connected to the gain device, the integrator and the feedforward device, the inverse printing device operative to receive a gain value from the gain device and the nominal actuator value from the feedforward device to provide a corrected actuator value to the integrator, the inverse printing device operative to apply an inverse sensitivity factor to the gain value.

2. A feedback control system according to claim 1, wherein the feedforward device includes a lookup table.

3. A feedback control system according to claim 1, wherein the gain device is one of a single input single output gain device and a multiple input multiple output gain device.

4. A feedback control system according to claim 1, wherein the input summing node receives the measured value and the target value, determines a difference between the measured value and the target value and outputs the difference to the gain device.

5. A feedback control system according to claim 4, wherein the gain device receives the difference and multiplies the difference by one of a plurality of matrix gain values to output a gain value.

6. A feedback control system according to claim 5, wherein the integrator receives and integrates the gain value to yield the new corrected actuator value.

7. A feedback control system according to claim 1, wherein the inverse printing device is one of a numerical model and a mathematical model of the developability control system.

8. A feedback control system according to claim 1, further comprising an actuator range determination and compensation device operative to determine whether the actuator value is within a predetermined range of actuator values defined as a minimum actuator value, a maximum actuator value and an intermediate actuator value being between the minimum actuator value and the maximum actuator value so that when the actuator range determination and compensation device determines that the actuator value is one of the minimum actuator value, the maximum actuator value and the intermediate actuator value, the actuator value received by the actuator range determination and compensation device is output from the actuator range determination and compensation device as an actuator value to the xerographic imaging device, when the actuator range determination and compensation device determines that the actuator value exceeds the maximum actuator value, the maximum actuator value is output as the actuator value to the xerographic imaging device and when the actuator range determination and compensation device determines that the actuator value is less than the minimum actuator value, the minimum actuator value is output as the actuator value to the xerographic imaging device.

9. A feedback control system according to claim 8, wherein the actuator range determination and compensation device includes an actuator value limiter device, a limiter summing node, an antiwindup compensator device and a compensator summing node serially connected in communication with each other, the actuator limiter device having an actuator value lookup table containing the minimum actuator value, the maximum actuator value and an intermediate actuator value, the limiter summing node operative to receive the actuator value from the nominal summing node and the actuator value from the actuator limiter device and determine an actuator value difference between the actuator value from the nominal summing node and the actuator value from actuator limiter device, the antiwindup compensator device operative to receive the actuator value difference from the limiter summing node and provide a compensated actuator value to the compensator summing node disposed between the integrator and the gain device for receiving the gain value, the compensator summing node operative to produce a compensated gain value to the integrator.

10. A feedback control system according to claim 9, further comprising a transform matrix device serially connected in communication between the actuator range determination and compensation device and the imaging device, the transform matrix device operative to transform soft actuator values to hard actuator values.

11. A feedback control system according to claim 1, further comprising a filter serially connected in communication with the at least one sensor and the input summing node and operative to filter noise signals from the measured value.

12. A feedback control system according to claim 11, wherein the filter is in communication with at least one of the gain device and the feedforward device.

13. A feedback control system for controlling developability of a xerographic imaging device having at least one optical sensor for measuring at least one value based upon at least one target value, the feedback control system comprising:

a feedforward device operative to receive and respond to the at least one target value and to output a nominal actuator value;

an input summing node for receiving the at least one measured value and the at least one target value and for outputting a difference between the at least one measured value and the at least one target value;

a gain device serially connected in communication with the input summing node for receiving the difference and multiplying the difference by one of a plurality of matrix gain values to output a weighted error;

an inverse printing device serially connected in communication with the gain device for receiving the weighted error and connected in communication with the feedforward device for receiving the nominal actuator value, the inverse printing device operative to apply an inverse sensitivity factor to the weighted error to output a corrected actuator value;

a compensator summing node serially connected in communication with the inverse printing device for receiving the corrected actuator value and a compensated actuator value and summing the corrected actuator value and the compensated actuator value to produce a compensated corrected actuator value;

an integrator serially connected in communication with the compensator summing node and operative to receive and integrate the compensated value to yield a new corrected actuator value;

a nominal summing node serially connected in communication with the integrator and operative to receive the new corrected actuator value from the integrator and the nominal actuator value from the feedforward device to output a summed actuator value;

an actuator limiter device serially connected in communication with the nominal summing node and operative to receive the summed actuator value and determine whether the summed actuator value is within a predetermined range of actuator values defined at a minimum actuator value, a maximum actuator value and an intermediate actuator value being between the minimum actuator value and the maximum actuator value so that when the actuator limiter device determines that the summed actuator value is one of the minimum actuator value, the maximum actuator value and the intermediate actuator value, an actuator value is output from the actuator limiter device, when the actuator limiter device determines that the summed actuator value exceeds the maximum actuator value, the maximum actuator value is output as the actuator value and when the actuator limiter device determines that the summed actuator value is less than the minimum actuator value, the minimum actuator value is output as the actuator value;

a limiter summing node operative to receive and sum the summed actuator value and the actuator value to yield an actuator value difference;

an antiwindup compensator device serially connected in communication with the limiter summing node and operative to produce and output the compensated actuator value to the compensator summing node; and a transform matrix device serially connected in communication with the actuator limiter device and operative to transform the actuator value into a hard actuator value and to output the hard actuator value to the xerographic imaging device.

14. A feedback control system according to claim 13, further comprising a filter wherein the measured value is filtered.

15. A feedback control system according to claim 13, wherein the feedforward device includes a lookup table.

16. A feedback control system according to claim 13, wherein the gain device is one of a single input single output gain device and a multiple input multiple output gain device.

17. A method for controlling an operation of a an imaging device having a sensor for measuring a value with respect to a device in the imaging device, comprising the steps of:

establishing a difference between the measured value and a target value;

multiplying the difference by a gain factor to yield a weighted error;

adjusting the weighted error by an inverse sensitivity factor to produce a corrected actuator value;

integrating the corrected actuator value with at least one previous corrected actuator value to produce a new corrected actuator value;

generating a nominal actuator value from the target value;

summing the new corrected actuator value and the nominal actuator value to yield an actuator value; and inputting the actuator value to the imaging device.

18. A method according to claim 17, further comprising the step of:

determining whether the actuator value either exceeds a predetermined maximum actuator value or lags a predetermined minimum actuator value and, upon determining that the actuator value exceeds the predetermined maximum actuator value, providing the predetermined maximum actuator value as the actuator value to the imaging device and, upon determining that the actuator value lags the predetermined minimum actuator value, providing the predetermined minimum actuator value as the actuator value to the imaging device.

19. A method according to claim 18, further comprising the step of modifying the corrected actuator value.

20. A method according to claim 19, wherein the modified corrected actuator value decreases when the actuator value exceeds the predetermined maximum actuator value and increases the actuator value lags the predetermined minimum actuator value.

21. A method according to claim 20, further comprising the step of transforming the actuator value from a soft actuator value to a hard actuator value and inputting the hard actuator value to the imaging device.

22. A method according to claim 17, further comprising the step of filtering at least the measured value.

23. A feedback control system for controlling an imaging device having at least one sensor for measuring at least one value with respect to a subsystem in the imaging device based upon a target value, the feedback control system comprising:

a controller device including an input summing node, a gain device that uses an inverse sensitivity factor to adjust a gain value used in processing a value received from the input summing node, and a nominal summing node serially connected in communication with each other, the input summing node and the gain device operative in combination with each other to receive and process the measured value and the target value to provide a weighted error to the nominal summing node; and a feedforward device connected to the nominal summing node and operative to receive and respond to the target value to output a nominal actuator value to the nominal summing node wherein the nominal summing node combines the weighted error and the nominal actuator value to provide an actuator value for controlling the imaging device.

* * * * *